US005410834A

United States Patent [19]

Benton et al.

[11] Patent Number: 5,410,834

[45] Date of Patent: May 2, 1995

[54] RIFLE WITH INTERCHANGEABLE BARREL

[75] Inventors: Michael E. Benton, Rte. #6, P.O. Box 972, Cleburne, Tex. 76031; Robert C. Brown, P.O. Box 1751, Tallulah, La. 71282

[73] Assignees: Michael Edward Benton, Cleburne, Tex.; Robert Charles Brown, Tallulah, La.

[21] Appl. No.: 102,583

[22] Filed: Aug. 5, 1993

[51] Int. Cl.[6] ..... F41A 21/48

[52] U.S. Cl. ..... 42/75.02

[58] Field of Search ..... 42/75.02, 75.01, 76.01, 42/77; 89/14.05

[56] References Cited

U.S. PATENT DOCUMENTS

| | | | |
|---|---|---|---|
| 529,455 | 11/1894 | Marlin | 42/75.02 |
| 1,373,888 | 4/1921 | Johnson | 42/75.02 |
| 1,393,057 | 10/1921 | Vollmer | 42/75.02 |
| 1,760,731 | 5/1930 | Williams | 42/76.01 |
| 2,529,733 | 11/1950 | King | 42/77 |
| 3,611,611 | 10/1971 | Quinney | 42/75.02 |
| 4,297,801 | 11/1981 | Kahn | 42/59 |
| 4,519,156 | 5/1985 | Shaw | 42/77 |
| 4,608,909 | 9/1986 | Peters | 89/196 |
| 4,648,192 | 3/1987 | Harness | 42/77 |
| 4,685,235 | 8/1987 | Bunning et al. | 42/75.02 |
| 4,893,426 | 1/1990 | Bixler | 42/75.01 |
| 4,989,359 | 2/1991 | Kinkner et al. | 42/77 |
| 5,020,260 | 6/1991 | Houghton | 42/75.02 |

*Primary Examiner*—David Brown

*Attorney, Agent, or Firm*—Richards, Medlock & Andrews

[57] ABSTRACT

Rifle with interchangeable barrel having an interchangeable barrel formed by attachment of a barrel to a receiving block which has locking lugs and is provided with alignment structure for aligning the interchangeable barrel with other components of the rifle and having a threaded passageway to receive a screw such that the interchangeable barrel may be easily removed and replaced.

16 Claims, 5 Drawing Sheets

RIFLE WITH INTERCHANGEABLE BARREL

TECHNICAL FIELD OF THE INVENTION

The present invention relates to fire arms, and in particular, rifles having interchangeable barrels.

BACKGROUND OF THE INVENTION

In the past there have been a number of attempts to produce various types of firearms with interchangeable barrels. Most of this effort has been concentrated on shotguns designed to accommodate different barrels. Some of these attempts are shown in U.S. Pat. Nos. 4,989,359 and 2,529,733. However, with shotguns, being area-fire weapons, there was not great concern about small variations in fit of the barrel which effect accuracy. Also, there have been attempts to place interchangeable barrels on pistols, together with interchangeable cylinders, as shown in U.S. Pat. No. 4,297,801.

An attempt to provide a rifle with interchangeable barrels is shown in U.S. Pat. No. 3,611,611, which requires the use of a concentric sleeve over the barrel to provide a rifle with an interchangeable barrel. This system suffers the disadvantages that it is complex and there is the possibility for slack between the rifle barrel and the sleeve, which can affect accuracy each time a barrel is removed and replaced.

There has been a continuing need to provide a rifle with interchangeable barrels which are both easily and quickly changed while maintaining accuracy of the weapon. The present invention provides a rifle with interchangeable barrels which conserves cost, allows the shooter to use one stock with which he is familiar and comfortable, and provides comparable weight and balance to the total firearm even when the different barrels are attached. All these factors are believed to be helpful to maintaining accuracy by allowing the shooter to maintain the same feel and touch, even though different caliber barrels are utilized. A major shortcoming of prior attempts to provide an interchangeable barrel for a rifle has been to achieve alignment of the barrel and sight system to maintain accuracy. Thus, interchangeable barrels have been successful in shotguns because minor variations in accuracy do not have much effect with these area-fire weapons. Interchangeable barrels or barrel inserts have found some use with pistols, but again in uses where accuracy is not a paramount concern. There has not been a successful large bore hunting rifle which uses interchangeable barrels. It is believed that this is directly attributable to difficulties with zeroing the weapon each time the barrel is changed. The present invention now permits use of interchangeable barrels for rifles which do not require rezeroing the weapon each time the barrel is changed.

Thus, the present invention satisfies a long-felt need and offers substantial advantages to the shooter. These advantages include being able to use the same stock assembly trigger housing and bolt guide configuration for the different barrels. Thus, the shooter continues to utilize the basic components with which he is familiar and comfortable. When the weapon is shouldered, it will come to his accustomed shooting position, unlike using separate rifles of the desired caliber where variations in stock length, shape and thickness require an adjustment for each different rifle. Also, the shooter has the advantage of being familiar with the same trigger pull and bolt action, thus further enhancing consistent habits which improve marksmanship. The rifle of the present invention also has the advantage that for a single stock assembly, a number of different rifle calibers may be used, thus allowing a hunter to take one stock and several barrels in a convenient-sized case for air travel to hunt large game and small game on one trip without the need to carry two or three different complete firearms in bulky containers such as long rifle cases which are frequently over four feet in length. The rifle of the present invention also offers the advantage that the system and mechanism for achieving the interchangeability of the barrels, each with its own sight system, allows the consistent return to zero each time the barrel is removed and replaced. Thus, the shooter only needs to zero the barrel initially. After that, the mounting mechanism allows the barrel to be removed and replaced without the need to rezero the rifle when barrels are changed. Thus, for example, when the hunter is on a trip in the wilderness, he may change barrels without the need to rezero the barrel. Without this feature, interchangeable barrels are not practical for the hunter, as many times he does not have the facilities, targets and other equipment necessary to accurately rezero the barrel while in the field.

SUMMARY OF THE INVENTION

The present invention relates to a rifle with interchangeable barrels. The interchangeable barrel of the present invention can be used on rifles which may be bolt action, semi-automatic or automatic. In one aspect, the invention provides for a receiving block which is easily interchangeable with other components of the rifle to provide for a quick change of the receiver block and its attached barrel such that it will align identically each time it is replaced. The receiver block forms a passageway with first and second ends. The first end of the passageway is threaded to receive a barrel of desired caliber. The second end of the passageway has locking lugs extending into the passageway for engagement of locking lugs on a rifle bolt. The receiver block also has an alignment structure for positioning the receiver block such that the vertical surfaces of the rifle bolt locking lugs and the receiver locking lugs will fit tightly together when the receiver block is mounted in place. The receiver block can also be provided with structure to provide alignment such that the axis of the receiver block will align with the axis of the rifle bolt travel to form a substantially single axis.

In another aspect, the invention relates to a receiver block as described above together with a barrel affixed to the receiver block. Yet another aspect of the present invention relates to an interchangeable barrel comprised of a barrel affixed to a receiver block of the present invention and having a sight mounted thereon.

Another aspect of the present invention relates to a rifle assembly with interchangeable barrel wherein a rifle bolt guide assembly is provided having a mounting member attached thereto for removably mounting a receiver block and barrel thereto. The mounting member has an alignment structure to provide for alignment along the axis of the firearm of the receiver locking lugs with the bolt locking lugs such that they mate together and also to align the axis of the receiver and barrel with the axis of the bolt travel such that they form substantially a single axis.

BRIEF DESCRIPTION OF THE DRAWINGS

The present invention will be better understood by reference to the detailed description and the accompanying drawings which represent several embodiments of the invention and are meant to be illustrative rather than limiting.

DETAILED DESCRIPTION

Figure 1:
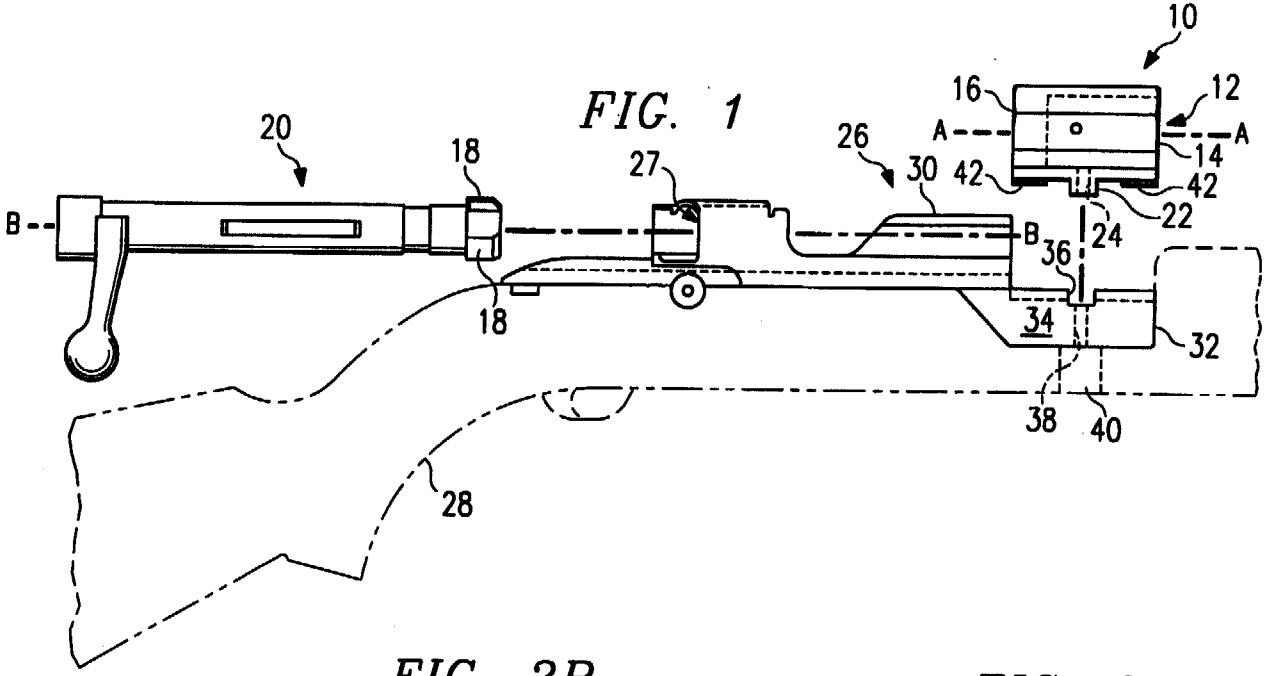
FIG. 1 is a side view of one embodiment of the present invention.

FIG. 1 shows a preferred embodiment of the present invention. The interchangeable barrel of the present invention may be used with any type of rifle such as bolt action, semi-automatic or automatic. While the invention is described and illustrated with relation to a bolt action rifle, the invention may be applied to any type of rifle. In FIG. 1, there is a receiver block 10 which defines a passageway therethrough along axis A—A. Passageway 12 has a first end 14 and a second end 16. First end 14 is adapted to be connected to a barrel of desired caliber, such as by use of threaded surfaces on the inside of the passageway 12. At the second end of the passageway are locking lugs (not shown in FIG. 1) protruding from receiver block 10 partially into passageway 12. These locking lugs are dimensioned to cooperate with corresponding locking lugs 18 on bolt 20. Any desired number of locking lugs and locking lug configurations may be used, but at least one locking lug is used. Preferably, two or more locking lugs are used on rifle bolt 20 with two or more corresponding locking lugs on receiver block 10. Receiver block 10 has alignment member 22 downwardly extending therefrom. Alignment member 22 may be of any desired shape which serves to mount the receiver block 10 in bolt guide assembly 26 and align the receiver block 10 in operative relationship with bolt 20 along axis A—A such that locking lugs 18 of the bolt 20 will engage locking lugs in the receiver block 10. This happens when the locking lugs cam together to lock the bolt in position for firing. Alignment member 22 may also serve to align receiver block 10 such that axis A—A of receiver block 10 corresponds and aligns with bolt axis B—B. Axes A—A and B—B are aligned to form a substantially single axis C—C of the assembled rifle. Preferably, alignment member 22 is provided with a passageway 24, shown in phantom, for receiving a threaded screw to attach receiver block 10 to bolt guide assembly 26. The alignment of receiver block 10 and bolt 20 must be such that axes A—A and B—B meet to form a substantially single axis C—C (called the rifle axis herein) and that both be held in the proper operative position along the axis. Bolt guide assembly 26 is mounted on stock 28, shown in phantom. The rifle axis is that common axis extending through the barrel, the receiver and the bolt of the assembled rifle.

Bolt guide assembly 26 has a wall 30 defining a passageway 27 to guide the bolt 20 along its axis B—B. Bolt guide assembly 26 has a first end 32 and protruding mounting member 34 for mounting of receiver block 10 to the bolt guide assembly 26. Protruding member 34 defines a channel 36 for receiving alignment member 22 of receiver block 10. Protruding member 34 also contains passageway 38 positioned such that it will be aligned with passageway 24 of receiver block 10. The stock may be configured such that a passageway 40 is provided in the stock to align with passageway 38 of bolt guide assembly 26, thereby allowing a threaded bolt or screw to be passed through it. Alternatively, the stock may be made so that it ends before passageway 38. Receiver block 10 is attached to protruding member 34 by inserting alignment member 22 into channel 36. A threaded bolt or screw can be passed through passageway 38 and engage threads in passageway 24, permitting receiver block 10 to be firmly held against protruding member 34.

Between the bottom of depending member 22 and the bottom of channel 36 there should be a small space provided when the two parts are drawn together. This prevents small grains of sand or dirt from interfering with the fit of rifle bolt 20 and receiver block 10. A space of about 0.01 inches or greater is sufficient for the purpose. Very close tolerances should be maintained between the rear of depending member 22 and the rear wall of channel 36 (rear indicating the direction away from the muzzle of the barrel). Preferably, the tolerance is about 0.002 inches or less. This will ensure that recoil forces are transferred from the depending member of the receiver block to bolt guide assembly 26, thereby sparing strain on the threaded bolts or other attaching mechanism utilized. Further, it is advisable to shape the parts so as to create void spaces adjacent to surfaces 42 and 47 when the receiver block and mounting member are drawn together such that dirt and small grains of sand or other particulate matter will not interfere with the flush fit of the mating surfaces 42 and 47. In a preferred embodiment, the attachment structure 22 is positioned midway along the receiver block and midway between pairs of alignment surfaces 42. While the attachment structure may be positioned behind or in front of the mating surface(s), that position is less desirable because as the two parts are drawn together, torque may be applied such that alignment of the rifle components is compromised.

Preferably, a second alignment structure is also provided in the form of one or more alignment surfaces 42 dimensioned to mate against corresponding alignment surfaces on protruding member 34 (shown in phantom in FIG. 1). Alignment surfaces 42 and corresponding alignment surfaces on protruding member 34 serve to align axis A—A with axis B—B such that they form substantially one axis (the rifle axis), thus permitting axial engagement of locking lugs 18 with locking lugs in receiver block 10.

Figure 2C:
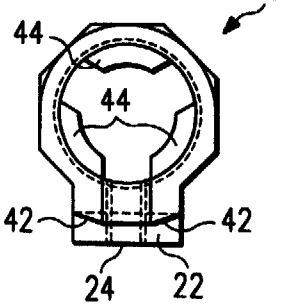
FIGS. 2*b* and 2*c* are front and rear end views of the receiver block of the present invention.
Figure 2B:
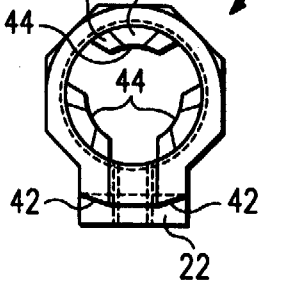
Figure 2A:
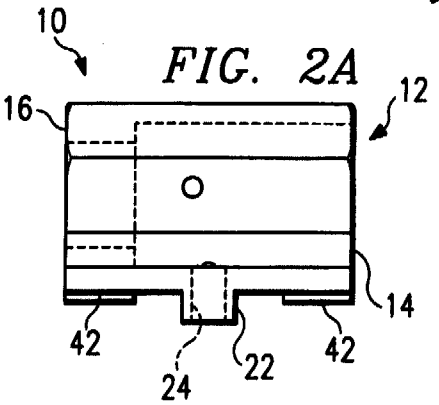
FIG. 2*a* is a side view of the receiver block of the present invention.
Figure 2D:
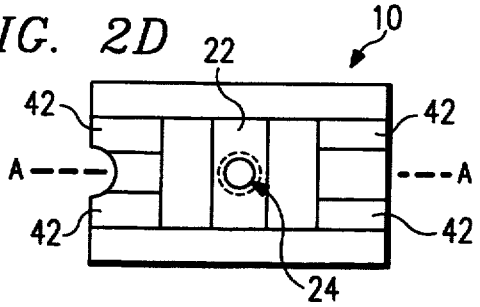
FIG. 2*d* is a bottom view of the receiver block of the present invention.

FIG. 2*a* is an enlarged view of the receiver block of FIG. 1. Like numbers refer to like elements. FIG. 2*b* is an end view from first end 14 of receiver block 10. From this view, one may see the receiver block locking lugs 44 which have a flat surface 45 which is perpendicular to axis A—A of the receiver block, and an angled surface 46 which is at an angle to the axis A—A of the receiver block to provide a camming action when engaging the locking lugs 18. FIG. 2*c* shows an end view of the receiver block 10 from the second end 16 of the receiver block. Like numbers refer to like elements. FIG. 2*d* is a bottom view of receiver block 10, and again, like numbers refer to like elements.

Figure 2E:
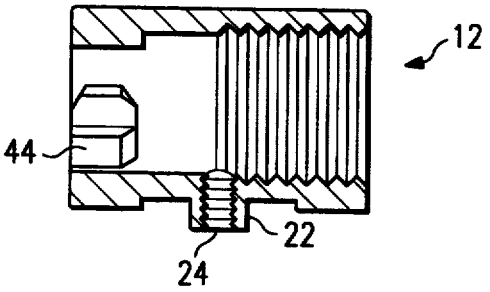
FIG. 2*e* is a cross-sectional view of a receiver block of the present invention.
Figure 3:
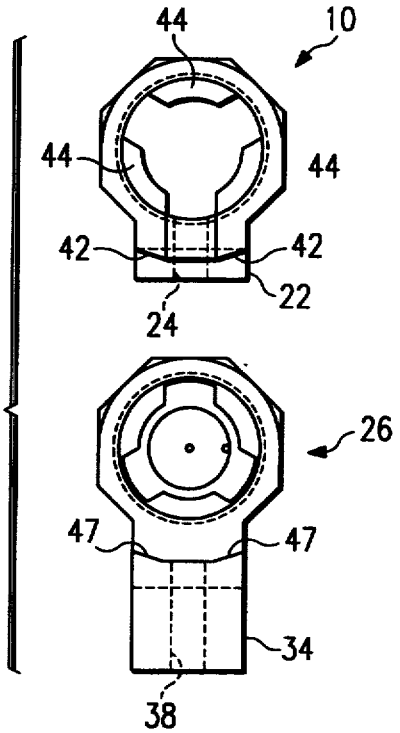
FIG. 3 is an exploded end view of the receiver block and bolt assembly of the present invention.

FIG. 3 is a partial frontal view of FIG. 1 and like numbers are used to refer to like elements. Alignment surfaces 42 on receiver block 10 are in a plane at an angle to a perpendicular plane passing through the rifle action when held in the normal firing position. Also, locking lugs 44 of receiver block 10 can be seen. (For purposes of clarity, the barrel is not shown in either FIGS. 1, 2 or 3.) Alignment surfaces 42 mate with alignment surfaces 47 of protruding member 34. In a preferred embodiment, alignment surfaces 42 form a dovetail or partial "V" shape and extend generally parallel to axis A—A. In a preferred embodiment, the alignment surfaces 42 are in planes parallel to axis A—A. It is not necessary that the mating surfaces be in planes parallel to axis A—A. For example, the alignment surfaces may be in planes at acute angles to the axis A—A. As shown, all of surfaces 42 need not be in the same plane. Alignment surfaces 47 are in planes corresponding to mating alignment surfaces 42 on the receiver block. As shown, one or more alignment surfaces may be used, and they can be in more than one plane. The alignment member 22 transfers recoil directly to bolt guide assembly 26 when the firearm is discharged. This prevents undue stress on the threaded screw attaching receiver block 10 to mounting member 34 which otherwise might damage or harm the threaded bolt. The force of recoil is transferred from the rear surface of depending member 22 to the rear wall of channel 36. FIG. 2*e* is a cross-sectional view of the receiver block. Alignment surfaces 42 and 47 are illustrated as flat surfaces. They are dimensioned such that they will mate with one another when receiver block 10 is positioned over protruding member 34 and tightened into position. While the surfaces are shown as flat surfaces, they may be of any desired configuration.

Figure 4:
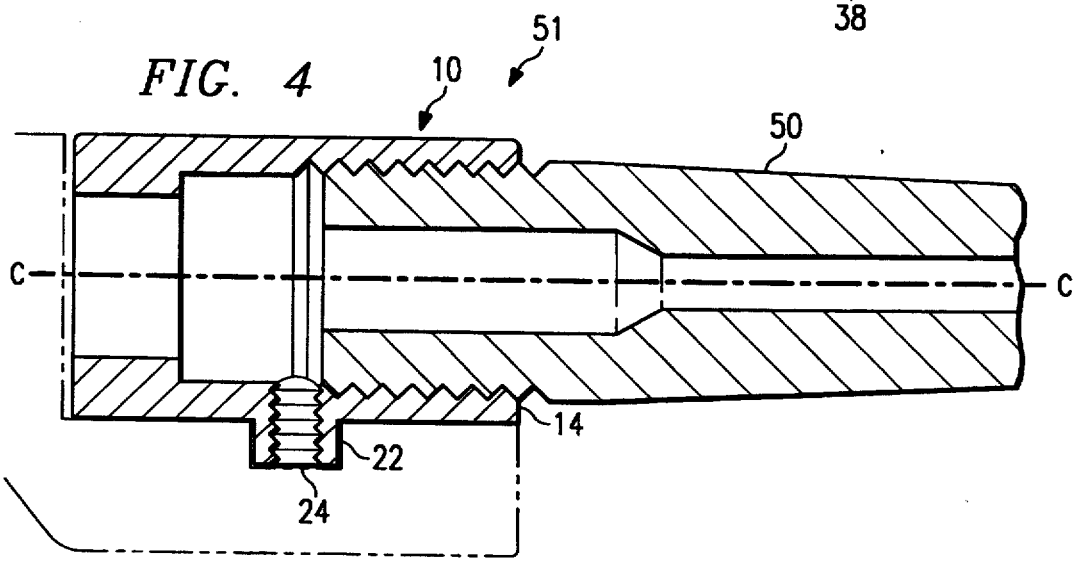
FIG. 4 is a cross-sectional view of the receiver block and barrel with attached barrel of the present invention.

FIG. 4 shows a cross-sectional area of a receiver block 10 and a barrel 50. Like numbers in FIG. 4 refer to like elements in FIGS. 1, 2 and 3. Desired barrels are combined with a receiver block to form a unified barrel and receiver block combination referred to herein as an interchangeable barrel 51. Once the barrel 50 is screwed in receiver block 10 and head space adjusted, the barrel 50 and receiver block 51 will remain as a single interchangeable barrel unit. Thus, a number of receiver blocks combined with different barrels give the shooter the ability to change barrels when desired. Standard barrels which can be used include 30.06, 308, 270, 243, 25.06, 6 mm, 22/250, and 280. Additionally, magnum barrels can be accommodated, such as 458 Winchester, 416 Remington, 375 H & H, 338, 340 Weatherby, 300 Winchester, 300 Weatherby, 7 mm Remington, 264, and 257 Weatherby. The same receiver block design can be used for each different barrel. The same bolt is utilized for each of the standard calibers, and the bolt should be long enough to extract the longest of the cartridges in the standard used calibers. Normally, a second rifle bolt will be provided for the magnum calibers. The magnum rifle bolts generally only differ from the standard bolt in the configuration of the face of the bolt which meets the rear of the cartridge. Again, the length of the magnum rifle bolt should be of a length sufficient to extract the longest of the cartridges in the magnum calibers. For convenience, we will refer to the combination of the receiver block 10 and barrel 50 as the interchangeable barrel 51. Thus, a hunter may take in a convenient-sized case, a stock with the trigger assembly and the bolt and bolt guide assembly as one piece, and one or more interchangeable barrels. For example, he can take a magnum barrel for large game and a smaller standard barrel for smaller game.

Furthermore, each interchangeable barrel is preferably equipped with a sight system, such as a scope, mounted on the interchangeable barrel. In a preferred embodiment, each interchangeable barrel will be mounted with a separate scope. Once the sight is aligned for that interchangeable barrel, there is no need for rezeroing each time the barrel is removed and replaced. Thus, the first practical interchangeable barrel is provided for a hunting rifle where accuracy is required.

Figure 5:
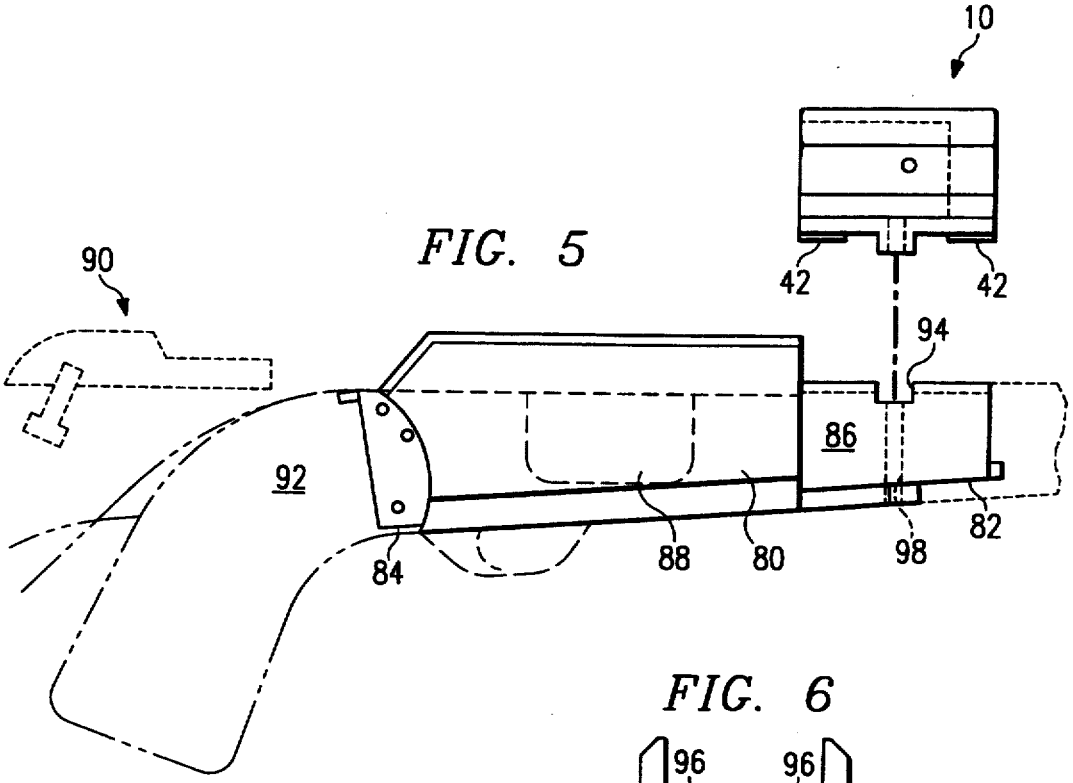
FIG. 5 is a side view of an alternate embodiment of the present invention.

FIG. 5 shows an exploded view of another embodiment. In FIG. 5 is shown base piece 80 having a first end 82 and a second end 84. On the first end of base piece 80 is mounting member 86 for mounting of receiver block 10. Base piece 80 also includes magazine well 88, shown in phantom, for the receipt of drop-in magazines for the different types of cartridges which can be used with the rifle. In this embodiment, base piece 80 receives a sliding bolt assembly 90, shown in phantom. The second end 84 of base piece 80 is attached to stock 92, shown in phantom. Mounting member 86 is provided with alignment channel 94 for receiving alignment member 22. Aligning surfaces (not shown in FIG. 5) are also provided on member 86.

Figure 6:
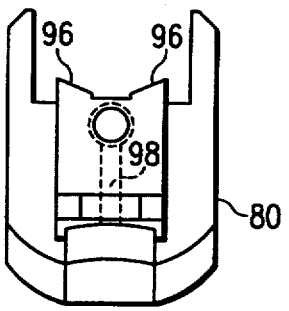
FIG. 6 is an end view of the mounting member of FIG. 5.

FIG. 6 is a frontal view of base piece 80 showing alignment surfaces 96 which are designed to mate with corresponding alignment surfaces on receiver block 10. A passageway 98 is provided through member 86 for the passage of a screw to draw down and removably affix receiver block 10 to mounting member 86. The same features regarding the alignment surfaces as discussed with the previous FIGS. 1–4, also apply to the embodiment shown in FIGS. 5 and 6. FIGS. 5 and 6 illustrate that it is not necessary for the bolt assembly 90 to be rigidly attached to the mounting member 86 for attaching receiver block 10. By use of base piece 80, the barrel may be rigidly attached to the base piece 80 and bolts slidably engaged to base piece 80 such that the locking lugs of the bolt cooperate with the locking lugs of the receiver block 10.

Base piece 80, and in particular mounting element 86, should be of a dimensionally stable material which is nondeformable. Dimensionally stable materials may be steel, aluminum, steel alloys, some very hard plastics, or other materials. Most wood is not considered dimensionally stable or nondeformable. Wood will swell and shrink with variations in moisture and temperature. Further, wood being relatively soft, will give way and compress under sufficient pressure, such as that exerted by a screw. Thus, the mounting element must provide a rigid connection between the interchangeable barrel and either the base unit or the bolt guide assembly (as the case may be) to provide consistent zeroing. It may be possible to treat certain woods with plastics or other material whereby they could be rendered dimensionally stable and be used for the mounting element, if such treatment would produce a mounting area that was dimensionally stable.

Figure 7:
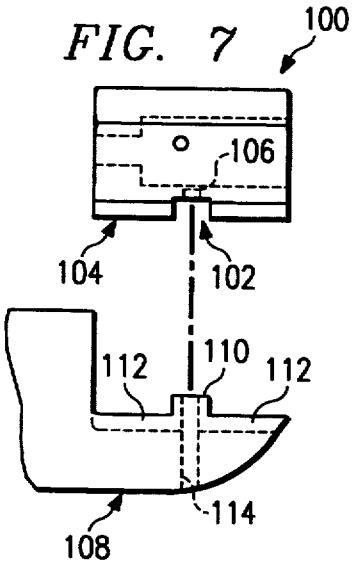
FIG. 7 is a partial side view of yet another embodiment of the present invention.
Figure 8:
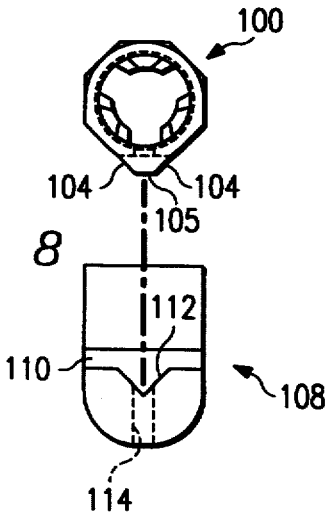
FIG. 8 is an end view of the embodiment shown in FIG. 5.

In the preferred embodiment, there are two alignment structures. The first is the alignment structure which provides proper alignment along axis C—C to provide proper positioning of receiver block 10 at a point along axis C—C such that when the rifle bolt is closed, locking lugs of the rifle bolt and of the receiver block will be held tightly together. The alignment surfaces principally serve to align axis B—B and axis A—A such that they form the single axis C—C which is substantially straight. This function is also served by alignment member 22. Thus, many other shapes may be utilized which achieve these same purposes. Thus, for example, in FIG. 7 a receiver block 100 is shown which has an alignment channel 102 and an alignment member 104. It is provided with threaded passageway 106 for receiving a threaded bolt. Mounting member 108 has an upwardly protruding alignment member 110, alignment channels 112 (shown in phantom), and passageway 114 for passage of a screw to engage threaded passageway 106. FIG. 8 shows an end view of the apparatus of FIG. 7. It shows that alignment member 104 is in the shape of a "V" and is received by a corresponding V-shaped channel 112 in mounting member 108. The "V" formed by surfaces 104 is truncated and has a flat bottom 105. This provides clearance between the bottom 105 and channel 112 when the pieces are drawn together. Thus, small particles of dirt in the bottom of channel 112 will not interfere with the fit. Thus, channel 102 and alignment member 110 cooperate to properly align the receiver block at a point along the axis defined by the rifle barrel. Surfaces 104 cooperating with V-shaped channel 112 function to align the axis of the bolt with the axis of the barrel such that they form a single axis.

Figure 9A:
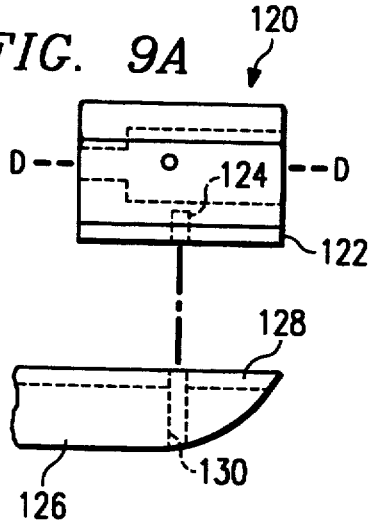
FIG. 9*a* is a partial side view of yet another embodiment of the present invention.
Figure 9C:
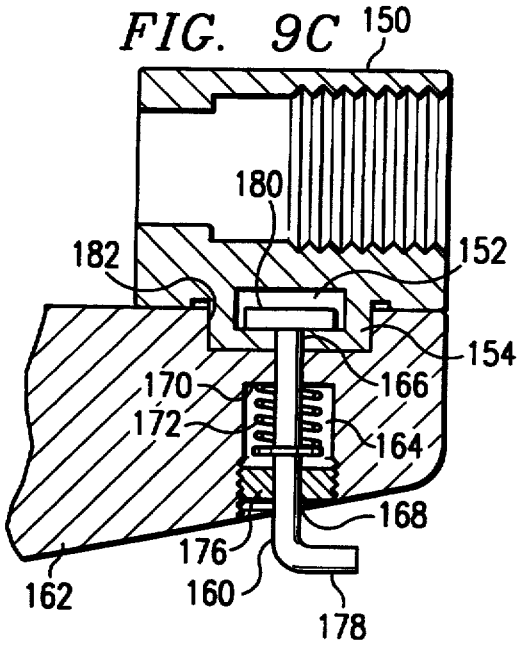
FIG. 9*c* is a cross-sectional view of another embodiment of the present invention.
Figure 9B:
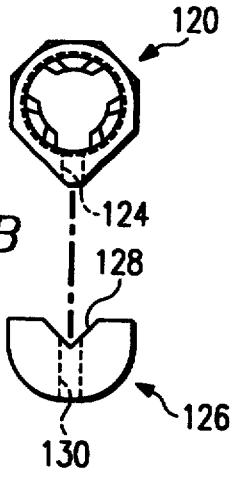
FIG. 9*b* is an end view of the embodiment shown in FIG. 9*a;*

FIGS. 9*a* and 9*b* show yet another embodiment, where FIG. 9*a* shows the side view and FIG. 9*b* shows an end view. In FIG. 9*a*, receiver block 120 is provided with an alignment member 122 disposed along the axis D—D of the receiver block and is provided with a threaded passageway 124. Mounting member 126 is provided with a corresponding channel 128 and passageway 130. Like numbers refer to like elements in FIG. 9*b*. In this embodiment, positioning of the receiving element along axis D—D is achieved by alignment of passageways 130 and 124 and the passage of a screw therethrough. Alignment of the axis of the receiver with the axis of the bolt is achieved by alignment protrusion 124 engaging channel 128. Thus, a number of other possible constructions also may be used.

The releasable attachment structure may be of any suitable construction which provides for releasable mounting of the receiver block onto the mounting member of either the base or of the bolt guide assembly, as the case may be. FIG. 9*c* shows a partial side cross-sectional view of an alternate embodiment. It shows receiver block 150 generally in the shape as described before. However, a chamber 152 is provided in depending element 154 which has a slotted opening 156. See FIG. 9*e*. The slotted opening receives a t-shaped retaining bar 160. The t-shaped retaining bar 160 is held in base 162 which defines a passageway 164 having an upper end 166 and lower end 168. The upper end of the passageway has a shoulder 170 which acts as a spring stop for spring 172. Spring 172 acts upon spring engaging surface 174 of the t-shaped retaining pin 160 and provides tension downwardly. The lower end 168 of passageway 164 can be threaded to receive nut 176 which holds the bar 160 and spring 170 in the base 162. As shown in FIG. 9*d*, which is a top view of the base 162, and FIG. 9*e*, which is a bottom view of the receiver block 150, when the head of the t-bar 160 is properly aligned it will pass through the slit opening 156 in the bottom of receiver block 150. After passing through, the t-bar is rotated in chamber 152 such that the edges of the bar 160 cannot be withdrawn through the slot 156. As shown in FIG. 9*c*, the spring tension of spring 172 pulls the t-shaped bar 164 and the receiver block together. To disassemble the rifle, the spring 172 is compressed by pushing on handle 178. The t-shaped top 180 of bar 160 is rotated until the bar may be extracted through the slot 156. As shown in FIGS. 9*c*, 9*d* and 9*e*, a channel 182 is provided to receive alignment number 154 to properly index the receiver block 150 with the remaining rifle parts not shown.

Figure 9F:
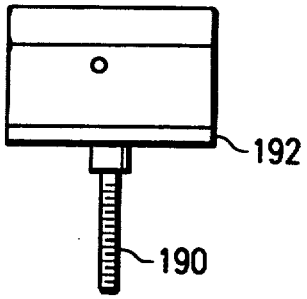
FIG. 9*f* is an alternate embodiment of a receiver block of the present invention.
Figure 9D:
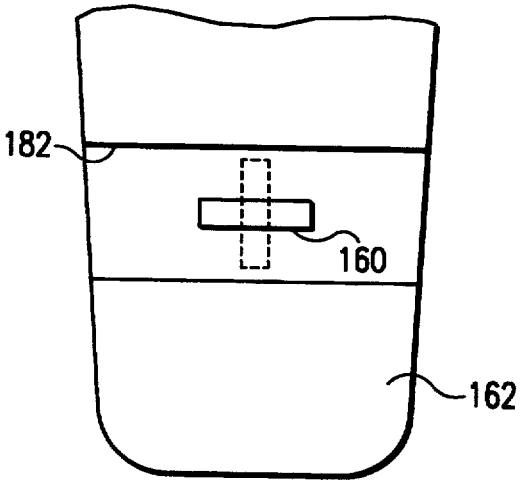
FIG. 9*d* is a top view of the lower element 162 of FIG. 9*c;*
Figure 9E:
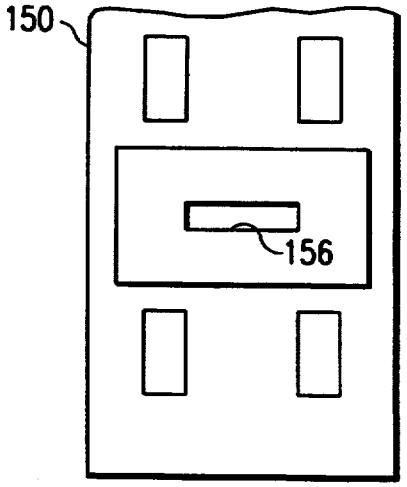
FIG. 9*e* is a bottom view of the upper element 150 of FIG. 9*c;*
Figure 9G:
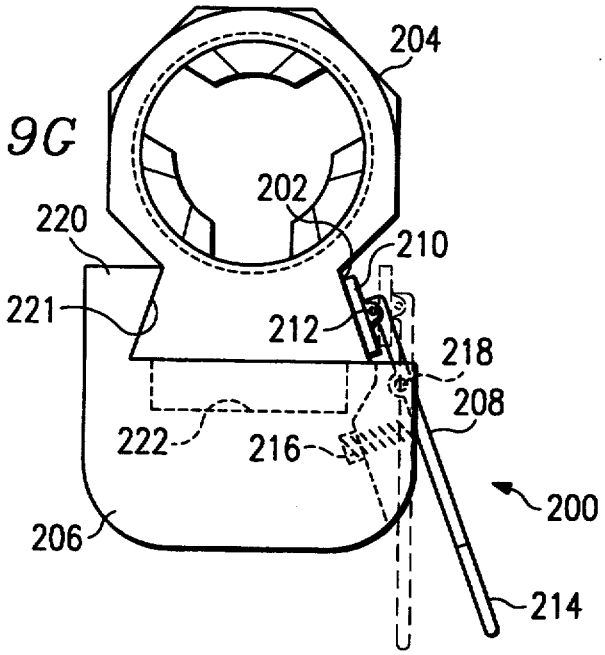
FIG. 9*g* is a front view of an alternate embodiment of the present invention.
Figure 9H:
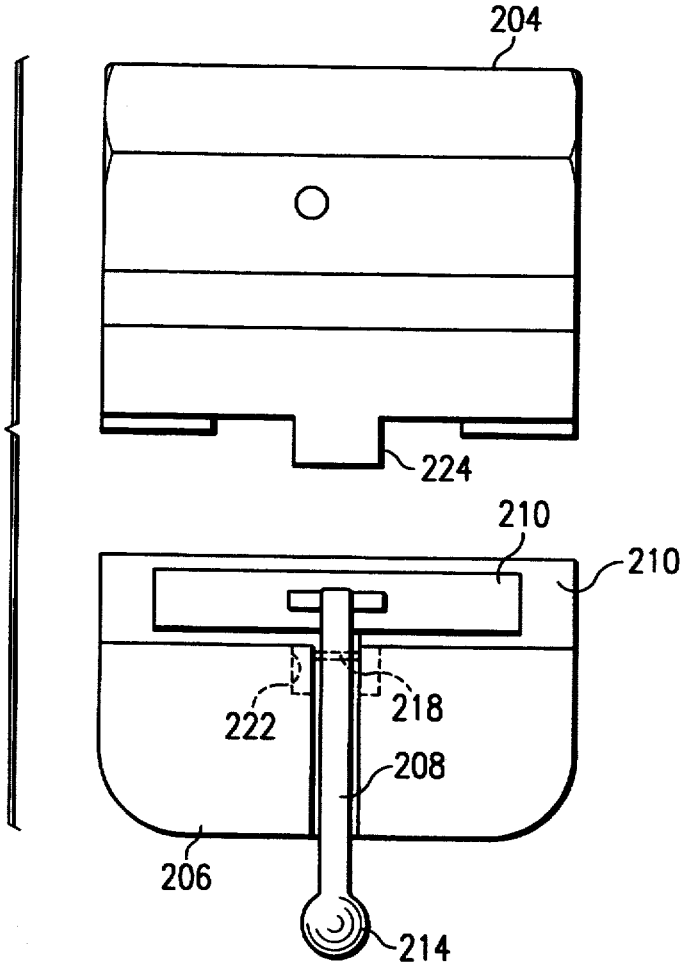
FIG. 9*h* is a side view of the embodiment shown in FIG. 9*g*.

In another embodiment shown in FIG. 9*f*, a threaded bolt 190 may be part of the receiver block 192 either formed integrally therewith or attached therewith by welding or other suitable methods. This threaded bolt then passes through a passageway such as passageway 38 shown in FIG. 1, and a nut may be threaded on the end to pull the receiver block and the base together. In yet another embodiment shown in FIG. 9*g*, the releasable structure may be composed of a spring clamp 200 acting on a clamping surface 202 of receiver block 204. As shown in FIG. 9*g*, spring clamp 200 is mounted on base 206. The clamp 200 shown is a spring action weighted clamp; however, a threaded clamp could also be used. As shown in the figure, the spring clamp 200 is mounted on base 206. It is comprised of a lever arm 208. On the first end, the lever arm is mounted to clamping jaw 210, which is preferably mounted on a pivot pin 212 so that it may pivot. On the second end of lever arm 208 is the surface for manipulation 214. Placed along the second end is a spring 216 which forces the second end of arm 208 outwardly about arm pivot pin 218, thereby pushing clamping jaw 210 inwardly into contact with the receiver block 204. To release the receiver block 204, the second end 214 of the lever 208 is pushed inwardly, thereby causing the clamping jaw 210 to rotate out to the position shown in phantom. The receiver block 204 may then be slid over and up. As shown, the base has one permanent side 220 having an angled shoulder 222 forming one side of a dove-tail, and the clamping jaw 210 acts as the other side of the dove-tail. Alternatively, the clamp could be designed so that the clamp jaws constitute both sides of the dovetail. FIG. 9*h* shows a side view of the embodiment shown in FIG. 9*g*. The base 206 is provided with channel 222 to receive alignment structure 224 extending from receiver block 204.

The foregoing description of the invention is illustrative and those skilled in the art will appreciate other variations of the invention not explicitly shown may be used.

We claim:

1. A receiver block for easy attachment and removal of a barrel on a rifle having a fixed bolt guide assembly, said receiver block comprising:

(a) a wall defining a receiver block having a generally cylindrical passageway therethrough having first and second ends and an axis therethrough;

(b) said first end of said passageway being adapted to receive the barrel;

(c) said second end of said passageway containing at least one locking lug extending partially into said passageway; and (d) alignment structure on said receiver block for removably mounting and aligning said receiver block on said bolt guide assembly.

2. A receiver block of claim 1 wherein said alignment structure is a threaded passageway in said receiver block wall.

3. The apparatus of claim 1 wherein the receiver block includes at least one alignment surface on the outside of said receiver block having a surface parallel to the axis of the receiver block passageway.

4. The apparatus of claim 1 wherein said alignment structure includes an alignment member extending downwardly from said receiver block and shaped to mate with a corresponding surface of the fixed bolt guide assembly on which it will be mounted.

5. The apparatus of claim 4 wherein said downwardly extending alignment member has a threaded passageway to receive a threaded bolt.

6. The apparatus of claim 4 wherein said downwardly extending alignment member is positioned perpendicular to the axis of said receiver block passageway.

7. A bolt guide assembly with interchangeable receivers comprising:

(a) a bolt guide assembly having bolt guiding structure and further having a first alignment structure extending therefrom; and (b) a receiver block having a passageway extending therethrough having first and second ends, the first end of said passageway adapted to receive a barrel and the second end of said passageway having locking lugs extending partially therethrough and further comprising a second alignment structure dimensioned to engage said first alignment structure.

8. A rifle comprising:

a stock;

a base attached to said stock having a receiver block mounting structure and a firearm bolt assembly receiving structure;

a firearm bolt assembly having a firearm bolt mounted on said firearm bolt assembly receiving structure of said base;

a receiver block having first and second ends and having a barrel attached to the first end of said receiver block and at least one locking lug at the second end of said receiver block and having at least one alignment structure; and a member releasible securing said receiver block to said receiver block mounting structure of said base.

9. A bolt guide assembly comprising:

(a) a frame defining:

(i) a fire arm bolt guiding structure; and (ii) a mounting member for releasably receiving and aligning a receiver block having a first alignment structure; said mounting member having a second alignment structure dimensioned to cooperate with said first alignment structure on said receiver block to receive and align the receiver block without frictional sliding contact between said first and second alignment structures; and (b) a firearm bolt slidably engaging said firearm bolt guiding structure.

10. The apparatus of claim 9 wherein said mounting member includes a passageway therethrough for passage of a threaded bolt.

11. The apparatus of claim 9 further comprising at least one alignment structure on said mounting member having a surface parallel to the axis of the firearm bolt.

12. The apparatus of claim 9 wherein said second alignment structure is a channel in said mounting member for aligning said receiver block.

13. The apparatus of claim 12 wherein said channel is perpendicular to the axis of the firearm.

14. A rifle comprising:

a bolt guide assembly having bolt guiding structure for guiding a firearm bolt along its axis, said bolt guide assembly further having a mounting member extending therefrom having at least one receiver block alignment structure;

a firearm bolt slidably mounted to said bolt guide assembly;

a stock attached to said bolt guide assembly;

a receiver block having first and second ends and having a barrel attached to the first end and at least one locking lug at its second end and having at least one alignment structure; and a member releasably securing said receiver block to said bolt guide assembly.

15. A replaceable barrel for a rifle having a fixed bolt guide assembly including a first alignment structure, said replaceable barrel comprising:

(a) a receiver block:

(i) providing a passageway having first and second ends extending therethrough; said first end of said passageway adapted to receive and engage a barrel; the second end of said passageway having at least one locking lug extending into said passageway for engagement of locking lugs on a rifle bolt; and (ii) having a second alignment structure dimensioned to cooperate with said first alignment structure on said bolt guide assembly of the rifle to receive and align the receiver block without frictional sliding contact between said first and second alignment structures; and (b) a barrel attached to said first end of said receiver block.

16. A rifle with interchangeable barrels comprising:

(a) a stock;

(b) a frame fixedly attached to said stock having:

(i) a bolt guide assembly; and (ii) a receiver block mounting structure having a first alignment structure;

(c) a firearm bolt assembly slidably engaging the bolt guide assembly of said frame, said bolt assembly having at least one locking lug;

(d) a receiver block having:

(i) first and second ends;

(ii) a barrel attached to the first end of said receiver block;

(iii) at least one locking lug at the second end of said receiver block for engaging the locking lug of the bolt assembly; and (iv) a second alignment structure; and (e) a member releasably securing the receiver block in operative association with the receiver block mounting structure of said frame without frictional sliding contact between said first and second alignment structures.

* * * * *